US006761604B1

(12) United States Patent
Hronek

(10) Patent No.: US 6,761,604 B1
(45) Date of Patent: Jul. 13, 2004

(54) FLOATATION DEVICE FOR A PREGNANT WOMAN

(76) Inventor: Stephanie D. Hronek, 1002 Astoria Ct., Greenwood, IN (US) 46143

( * ) Notice: Subject to any disclaimer, the term of this patent is extended or adjusted under 35 U.S.C. 154(b) by 0 days.

(21) Appl. No.: 10/434,542

(22) Filed: May 12, 2003

(51) Int. Cl.[7] ..... B63B 35/73
(52) U.S. Cl. ..... 441/129
(58) Field of Search ..... 441/129–132; 5/703, 706, 707, 708, 711–713; 472/129

(56) References Cited

U.S. PATENT DOCUMENTS

| | | | | |
|---|---|---|---|---|
| 4,054,960 A | | 10/1977 | Pettit et al. | |
| 4,382,306 A | | 5/1983 | Lickert | |
| 5,185,897 A | * | 2/1993 | Van Laanen | 5/710 |
| D335,999 S | | 6/1993 | Van Driessche | |
| D350,586 S | | 9/1994 | Francis | |
| 5,675,854 A | | 10/1997 | Zibelin | |
| 5,679,040 A | | 10/1997 | Bianchi-Holm | |
| D392,145 S | | 3/1998 | Thurston | |
| 6,171,161 B1 | * | 1/2001 | Peterson | 441/130 |

* cited by examiner

*Primary Examiner*—Sherman Basinger

(57) ABSTRACT

A floatation device for a pregnant woman for providing a flotation device for pregnant woman to relax comfortably in a prone position. The floatation device for a pregnant woman includes a floatation raft member having a selected thickness; and also includes a headrest member being attached upon a top and along a head end of the floatation raft member; and further includes handle members being attached upon the top of the floatation raft member; and also includes an insert member being removably attached to the floatation raft member; and further includes fastening members for fastening the insert member to the floatation raft member.

3 Claims, 2 Drawing Sheets

FLOATATION DEVICE FOR A PREGNANT WOMAN

BACKGROUND OF THE INVENTION

1. Field of the Invention

The present invention relates to floatation devices and more particularly pertains to a new floatation device for a pregnant woman for providing a flotation device for pregnant woman to relax comfortably in a prone position.

2. Description of the Prior Art

The use of floatation devices is known in the prior art. More specifically, floatation devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,054,960; U.S. Pat. No. 5,679,040; U.S. Pat. No. 5,675,854; U.S. Pat. No. 4,382,306; U.S. Pat. No. Des. 350,586; U.S. Pat. No. Des. 335,999; and U.S. Pat. No. Des. 392,145.

While these devices fulfill their respective, particular objectives and requirements, the aforementioned patents do not disclose a new floatation device for a pregnant woman. The prior art includes air raft members upon which users can rest in a prone position.

SUMMARY OF THE INVENTION

The general purpose of the present invention, which will be described subsequently in greater detail, is to provide a new floatation device for a pregnant woman which has many of the advantages of the floatation devices mentioned heretofore and many novel features that result in a new floatation device for a pregnant woman which is not anticipated, rendered obvious, suggested, or even implied by any of the prior art floatation devices, either alone or in any combination thereof. The present invention includes a floatation raft member having a selected thickness; and also includes a headrest member being attached upon a top and along a head end of the floatation raft member; and further includes handle members being attached upon the top of the floatation raft member; and also includes an insert member being removably attached to the floatation raft member; and further includes fastening members for fastening the insert member to the floatation raft member. None of the prior art includes the combination of the elements of the present invention.

There has thus been outlined, rather broadly, the more important features of the floatation device for a pregnant woman in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new floatation device for a pregnant woman which has many of the advantages of the floatation devices mentioned heretofore and many novel features that result in a new floatation device for a pregnant woman which is not anticipated, rendered obvious, suggested, or even implied by any of the prior art floatation devices, either alone or in any combination thereof.

Still another object of the present invention is to provide a new floatation device for a pregnant woman for providing a flotation device for pregnant woman to relax comfortably in a prone position.

Still yet another object of the present invention is to provide a new floatation device for a pregnant woman that is easy and convenient to set up and use.

Even still another object of the present invention is to provide a new floatation device for a pregnant woman that allows a pregnant woman to relax on her stomach or to lie comfortably on her back and receive an even tan on the front and back of her body.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
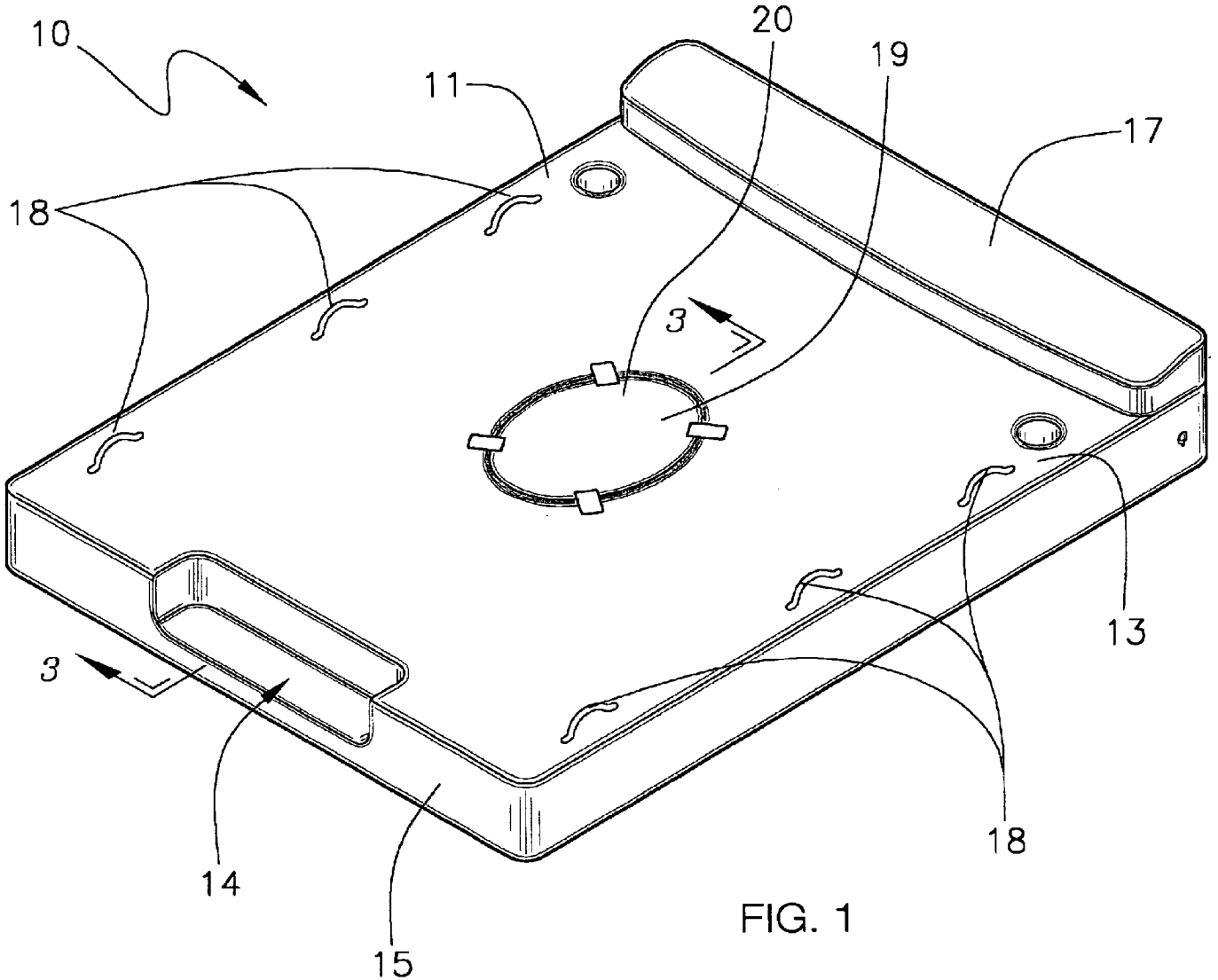
FIG. 1 is a perspective view of a new floatation device for a pregnant woman according to the present invention.
Figure 2:
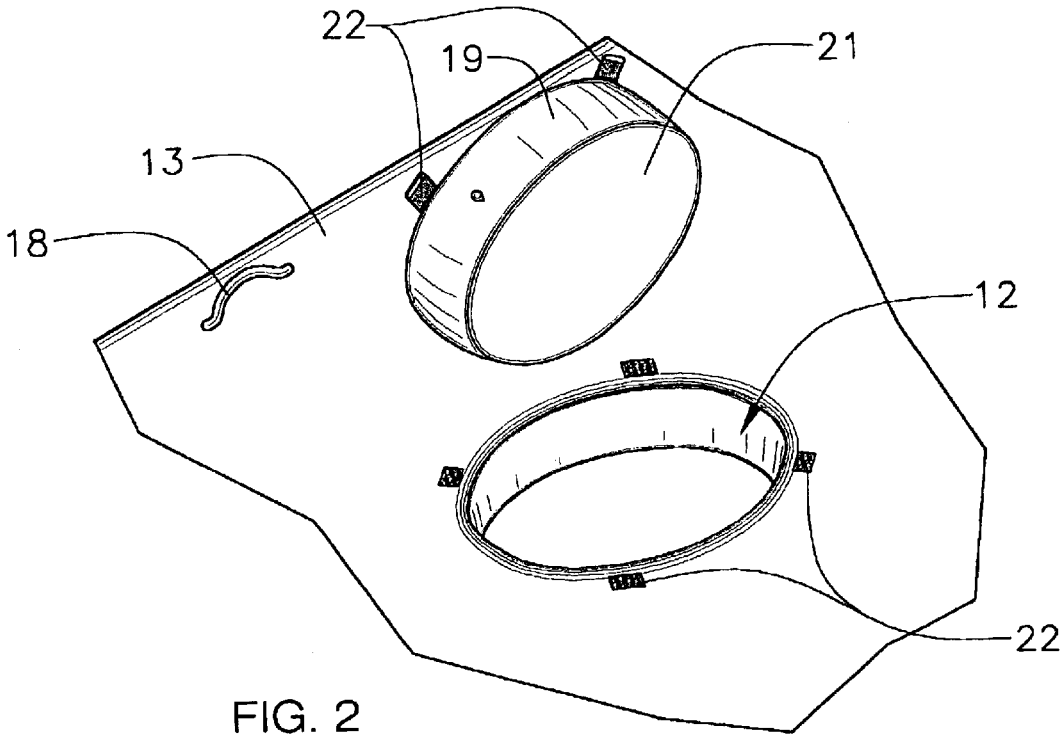
FIG. 2 is a detailed partial perspective view of the present invention.
Figure 3:
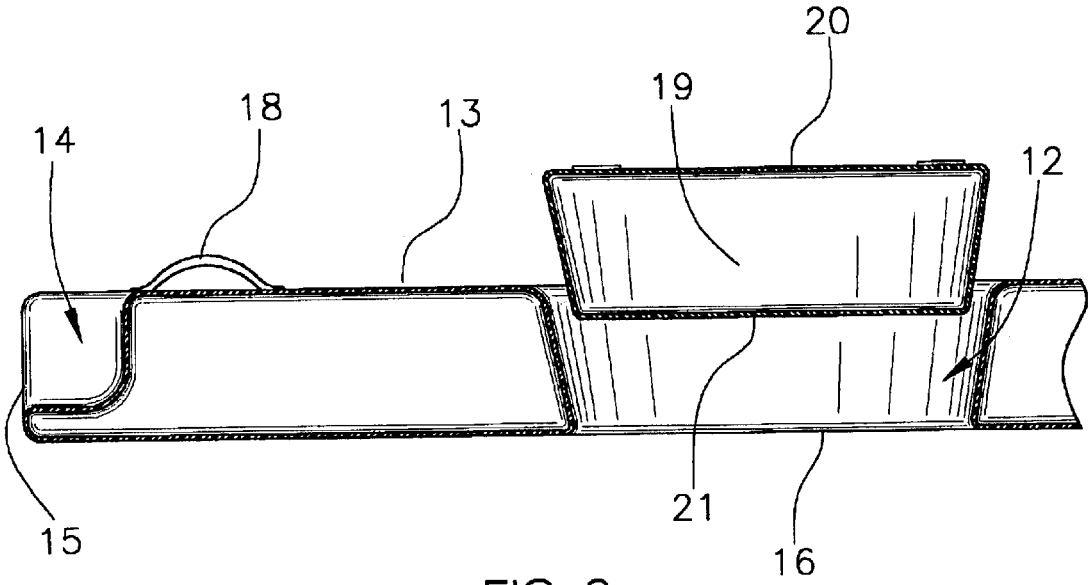
FIG. 3 is a cross-sectional view of the present invention.

With reference now to the drawings, and in particular to FIGS. 1 through 3 thereof, a new floatation device for a pregnant woman embodying the principles and concepts of the present invention and generally designated by the reference numeral 10 will be described.

As best illustrated in FIGS. 1 through 3, the floatation device for a pregnant woman 10 generally comprises a floatation raft member 11 having a selected thickness. The floatation raft member 11 has top, side, end and bottom walls 13, 15, 16, and also has an air-filled chamber disposed therein, and has a stomach-receiving opening 12 being centrally disposed through the raft member 11, and also has a step recess 14 being disposed in a foot end 15 and a portion of the top wall 13 thereof. The stomach-receiving opening 12 is generally oval-shaped, and has an expanse adapted to receive a stomach of a pregnant woman, and also is inwardly beveled from the top wall 13 to the bottom wall 16 of the floatation raft member 11. The step recess 14 is disposed intermediate of the side walls of the floatation raft member 11 and is disposed in an upper portion of the foot end 15 and in a portion of the top wall 13 of the floatation raft member 11. A headrest member 17 is conventionally attached upon the top wall 13 and along a head end of the floatation raft member 11.

Handle members 18 are integrally attached to the top wall 13 of the floatation raft member 11. The handle members 18 are straps being formed in loops and being securely and spacedly attached and aligned in rows and columns on the top wall 13 of the floatation raft member 11.

An insert member 19 is removably attached to the floatation raft member 11. The insert member 19 has top 20, side, and bottom walls and an air-filled chamber being disposed therein, and also has a selected thickness and expanse to substantially fill the stomach-receiving opening 12 with the top wall of the insert member 19 being substantially flush with the top wall 13 of the floatation raft member 11 upon the insert member being removably disposed in the stomach-receiving recessed opening 12. The insert member 19 is conical shaped so that the insert member 19 substantially seats in the stomach-receiving opening 12.

Fastening members 22 for fastening the insert member 19 to the floatation raft member 11 includes strips of hook and loop fasteners being conventionally attached to the top wall of the insert member 19 and to the top wall 13 of the floatation raft member 19.

In use, the user places the floatation raft member 11 on a body of water. The user would climb onto the floatation raft member 11 by stepping onto the step recess 14 and lying on the floatation raft member 11 on her back in a prone position to tan the front side of her torso. The user can also tan the back side of her torso by removing the insert member 19 and allowing her stomach to be positioned into the stomach-receiving opening 12. The user may relax comfortably on her stomach or back with out any harm to her fetus.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the floatation device for a pregnant woman. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A floatation device for a pregnant woman comprising:

a floatation raft member having a selected thickness, said floatation raft member having top, side, end, and bottom walls, and has an air-filled chamber disposed therein, and further having a stomach-receiving opening being centrally disposed therethrough, and also having a step recess being disposed in a foot end and a portion of said top wall thereof, said stomach-receiving opening being generally oval-shaped, and having an expanse adapted to receive a stomach of a pregnant woman, and further is inwardly beveled from said top wall to said bottom wall of said floatation raft member, said step recess being disposed intermediate of sides of said floatation raft member and being disposed in an upper portion of said foot end and in a portion of said top wall of said floatation raft member;

a headrest member being attached upon a top and along a head end of said floatation raft member;

handle members being attached upon said top of said floatation raft member, said handle members being straps being formed in loops and being securely and spacedly attached and aligned in rows and columns on said top wall of said floatation raft member;

an insert member being removably attached to said floatation raft member; and fastening members for fastening said insert member to said floatation raft member.

2. The floatation device for a pregnant woman as described in claim 1, wherein said insert member has top, bottom and side walls, and also has a selected thickness and expanse to substantially fill said stomach-receiving opening with said top wall of said insert member being substantially flush with said top wall of said floatation raft member upon said insert member being removably disposed in said stomach-receiving opening, said insert member being conical-shaped to facilitate seating of said insert member in said stomach-receiving opening.

3. The floatation device for a pregnant woman as described in claim 2, wherein said fastening members includes strips of hook and loop fasteners being attached to said top wall of said insert member and to said top wall of said floatation raft member.

* * * * *